US005513495A

United States Patent [19]

West et al.

[11] Patent Number: 5,513,495

[45] Date of Patent: May 7, 1996

[54] COOLING SYSTEM AND METHOD FOR PRODUCING ICE TO COOL A LIQUID

[75] Inventors: Christopher P. West, Scarborough; David B. Neuwen, Ballajura, both of Australia

[73] Assignee: Thermotech International Pty Ltd., Mount Hawthorn, Australia

[21] Appl. No.: 211,878

[22] PCT Filed: Oct. 20, 1992

[86] PCT No.: PCT/AU92/00560

§ 371 Date: Dec. 6, 1994

§ 102(e) Date: Dec. 6, 1994

[87] PCT Pub. No.: WO93/08432

PCT Pub. Date: Apr. 29, 1993

[30] Foreign Application Priority Data

Oct. 22, 1991 [AU] Australia ..... PK9081

[51] Int. Cl.[6] ..... F25B 21/02

[52] U.S. Cl. ..... 62/3.63; 62/3.64; 62/389; 222/146.6

[58] Field of Search ..... 62/3.2, 3.63, 3.64, 62/3.7, 59, 139, 389, 398; 222/146.6, 185, 181, 51

[56] References Cited

U.S. PATENT DOCUMENTS

| | | | |
|---|---|---|---|
| 2,572,508 | 10/1951 | Muffly | 62/59 |
| 3,008,299 | 11/1961 | Sheckler | 62/3.64 |
| 3,250,433 | 5/1966 | Christine et al. | 62/3.64 |
| 3,310,953 | 3/1967 | Rait | 62/389 |
| 4,055,053 | 10/1977 | Elfving et al. | 62/3.63 |
| 4,727,720 | 3/1988 | Wernicki | 62/3.61 |
| 4,866,945 | 9/1989 | Bender et al. | 62/3.61 |
| 4,913,713 | 4/1990 | Bender et al. | 62/3.61 |
| 4,958,505 | 9/1990 | Swanson | 62/398 |
| 4,993,229 | 2/1991 | Baus et al. | 62/3.64 |
| 4,996,847 | 3/1991 | Zickler | 62/3.64 |
| 5,072,590 | 12/1991 | Burrows | 62/3.64 |

FOREIGN PATENT DOCUMENTS

| | | |
|---|---|---|
| 34173/78 | 9/1979 | Australia . |
| 40634/85 | 11/1985 | Australia . |
| 7091887 | 10/1987 | Australia . |
| 70918/87 | 10/1987 | Australia . |
| 83584/91 | 3/1992 | Australia . |
| 0050473 | 4/1982 | European Pat. Off. . |
| 3044202 | 5/1982 | Germany . |

*Primary Examiner*—Henry A. Bennet
*Assistant Examiner*—William C. Doerrler
*Attorney, Agent, or Firm*—Merchant, Gould, Smith, Edell, Welter & Schmidt

[57] ABSTRACT

A cooling system (10) which produces ice and then uses the energy stored in the ice to cool a liquid, the cooling system (10) having a supply of liquid in fluid communication with a cooling chamber (12), there being an ice producing means (24) located at least partially within the cooling chamber (12), the ice producing means (24) including a thermoelectric module (26) having a cold-side interface (28) and a hot-side interface (34), the cold-side interface (28) being in direct or indirect communication with liquid in the cooling chamber (12) and the hot-side interface (34) being located externally of the cooling chamber (12) and being connected to a hot-side heat sink (36) for the dissipation of heat generated thereby, and a power supply being connected to the thermoelectric module (26), wherein as heat is absorbed from the liquid by the cold-side interface (28), local freezing of the liquid immediately about the cold-side interface (28) occurs and ice is produced thereon.

21 Claims, 2 Drawing Sheets

COOLING SYSTEM AND METHOD FOR PRODUCING ICE TO COOL A LIQUID

THIS INVENTION relates to cooling systems, but in particular relates to water coolers for drinking water.

Cooling systems are commonly used in many domestic, commercial, or industrial situations where there is a need or a desire for the provision of cold drinking water. Water coolers in particular are traditionally fairly large although this is often used advantageously by designing aesthetically pleasing bodies or stands.

Water coolers in particular generally come in two forms; those that have an upper inverted bottle of water and a lower stand or body, and those that are supplied with mains water and thus simply have a body with an upper drinking spout or the like.

Traditionally, both of these types of water coolers have used standard refrigeration components such as a compressor, an evaporator, a condenser and a thermostat. The compressor compresses vapour into a high pressure gas which is then condensed into a liquid in the condenser. The high pressure liquid is then expanded in the evaporator and absorbs heat as it changes state. The thermostat controls the temperature of the medium being cooled by switching the compressor on and off as required. Typically, these systems run for only 6 to 10 hours per day and require comparatively large amounts of energy to run and large amounts of space to house the apparatus.

The cooling system of the present invention utilises a different principle to that described above. The present invention is characterised by a cooling system which produces ice and then uses energy stored in the ice to cool a liquid. In this respect, and as indicated above, the cooling system is most advantageously used as a water cooler.

The basic operating principle responsible for the production of the ice in the cooling system of the present invention is that of a thermoelectric cooler. This principle, commonly called the Peltier effect, relies on the absorption or generation of heat as a current passes through a junction of two dissimilar conductive materials.

In any thermoelectric module there are two metal interfaces which provide two functions. Firstly, the cold-side interface absorbs heat from the medium to be cooled while the hot-side interface dissipates heat to another medium, typically ambient air via a heat sink such as a vaned baffle. Secondly, the interfaces enable the module itself to be sealed into a plastic housing, as thermoelectric modules are readily degraded by condensation.

Thus, the present invention provides a cooling system which produces ice and then uses the energy stored in the ice to cool a liquid, the cooling system having a supply of liquid in fluid communication with a cooling chamber, there being an ice producing means located at least partially within the cooling chamber, the ice producing means including a thermoelectric module having a cold-side interface and a hot-side interface, the cold-side interface being in direct or indirect communication with liquid in the cooling chamber and the hot-side interface being located externally of the cooling chamber and being connected to a hot-side heat sink for the dissipation of heat generated thereby, and a power supply being connected to the thermoelectric module, wherein as heat is absorbed from the liquid by the cold-side interface, local freezing of the liquid immediately about the cold-side interface occurs and ice is produced thereon.

More particularly, the present invention provides a water cooler having a supply of drinking water in fluid communication with a cooling chamber, there being an ice producing means located at least partially within the cooling chamber, the ice producing means including a thermoelectric module having a cold-side interface and a hot-side interface, the cold-side interface being in direct or indirect communication with water in the cooling chamber and the hot-side interface being located externally of the cooling chamber and being connected to a hot-side heat sink for the dissipation of heat generated thereby, and a power supply being connected to the thermoelectric module, wherein as heat is absorbed from the water by the cold-side interface, local freezing of the water immediately about the cold-side interface occurs and ice is generated thereon.

In a preferred form of the invention, the cold-side interface is indirectly in communication with the water, there being a cooling surface and a cold-side heat sink located intermediate the cold-side interface and the water. For example, a copper disc may be fixed to the cold-side interface so that the heat is absorbed through the disc to form ice on the surface of the disc. Alternatively, an aluminium block may define the cold-side heat sink and the surface of the block will then be the cooling surface. In this form, the surface may include a stainless steel face to assist in preventing corrosion.

The water cooler preferably also includes a sensing means in the form of a photo-optic sensing device, to determine when the ice produced is large enough to be released into the cooling chamber. However, it will be appreciated that other forms of sensing devices, such as an ultra-sonic sensing device may be utilised.

Once the first block of ice is released, the thermoelectric module produces a second block of ice which ultimately is also released, and so on. In this way, the cooling chamber is filled with ice and water and as the heat of the water is absorbed by the ice (thus melting the ice), the temperature of the water is reduced. The water cooler thus provides cooled drinking water by producing ice.

The photo-optic sensing device is preferably an infrared beam of light capable of being received by a sensor such as a photo transistor. The sensing device is preferably configured so that the beam of light passes over the cold-side side interface of the thermoelectric module (or the cooling surface if utilised) within the cooling chamber. In this respect, reference to the cold-side interface in the following description is to be understood to refer to that part of the ice producing means that is in contact with the water although in the most preferred embodiment of the present invention that will be the cooling surface.

An infrared beam is preferred as this is not effected by ambient or white light which may enter the cooling chamber, however, the sensing device may use other light forms or varying wave lengths as necessary and if required.

The beam preferably passes over the cold-side interface at a height considered suitable for a corresponding thickness of ice. As the ice grows, the beam is broken and the sensor switches the power supply to the thermoelectric module off.

By switching the power to the module off, heat is allowed to flow from the heat sink back through the hot-side interface to the cold-side interface. The cold-side interface rises in temperature until it defrosts a thin layer of ice immediately adjacent thereto. The ice block thus created floats towards the surface of the water, moving out of the infrared beam and thus switching the power to the module back on to begin generation of the next block of ice.

It will be understood that when the cooling chamber is full of ice, the infrared beam will remain broken and thus the power to the module will remain off. Once a sufficient amount of ice has melted, the power to the module will be turned back on by the return of the infrared beam.

The water cooler of the present invention has been found to be capable of cooling drinking water to between 1° and 3° Celsius. However, water at this temperature is often considered unacceptably cold. Therefore, it is preferred to warm the water somewhat before it is dispensed.

In a preferred form, the water cooler of this invention may also include a water mixing device which allows preferential mixing of an amount of the incoming ambient water with the cooled water of the cooling chamber.

Further, the water cooler of this invention may also include an ice dispersing means located above the thermoelectric module to assist in dispersing the released ice blocks throughout the body of the cooling chamber to prevent an uneven stacking of those ice blocks. The ice dispersing means is preferably configured to be a part of a water baffle cap which is preferably provided to separate an inverted water bottle (where that is used as the supply of water) from the cooling chamber. The water baffle cap also serves to prevent the ice generated from flowing into the bottle which would displace water and possibly cause flooding, and it also prevents the water in the bottle from itself becoming too cold. In this respect, the cooling chamber is an insulated chamber and thus is generally unaffected by outside conditions. However, this is not the case for the water bottle and any energy in the water bottle in the form of cold water would be lost quite rapidly. Furthermore, the water mixing device referred to above may also be incorporated into the water baffle cap so that water may be drawn for dispensing from both above and below the water baffle cap as required.

However, in an alternative form the need for an ice dispersing means may be avoided by configuring the cooling surface of the ice producing means such that the ice blocks formed are unlikely to stack together. For instance, rather than simply providing a flat cooling surface, a generally concave surface may be provided, preferably being substantially conical in configuration.

The present invention will now be more fully described in relation to a preferred embodiment illustrated in the accompanying drawings. However, it will be understood that the following description is not to limit the generality of the invention as described above.

Figure 1:
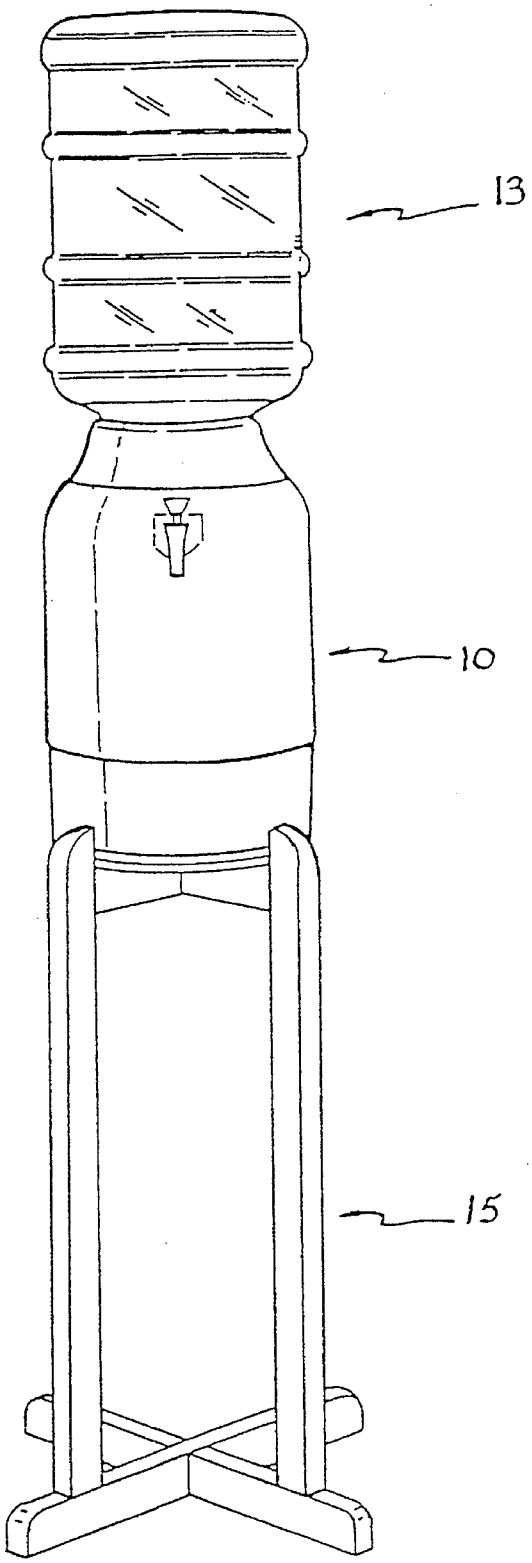
FIG. 1 is a side view of a water cooler embodying the invention in use.

Illustrated in FIG. 1 is a water cooler 10 having an inverted water bottle 13 attached thereto, the assembly of cooler and bottle being supported by a stand 15. It will be understood that the present invention is only related to the important aspects of the cooling system of the water cooler 10.

Figure 2:
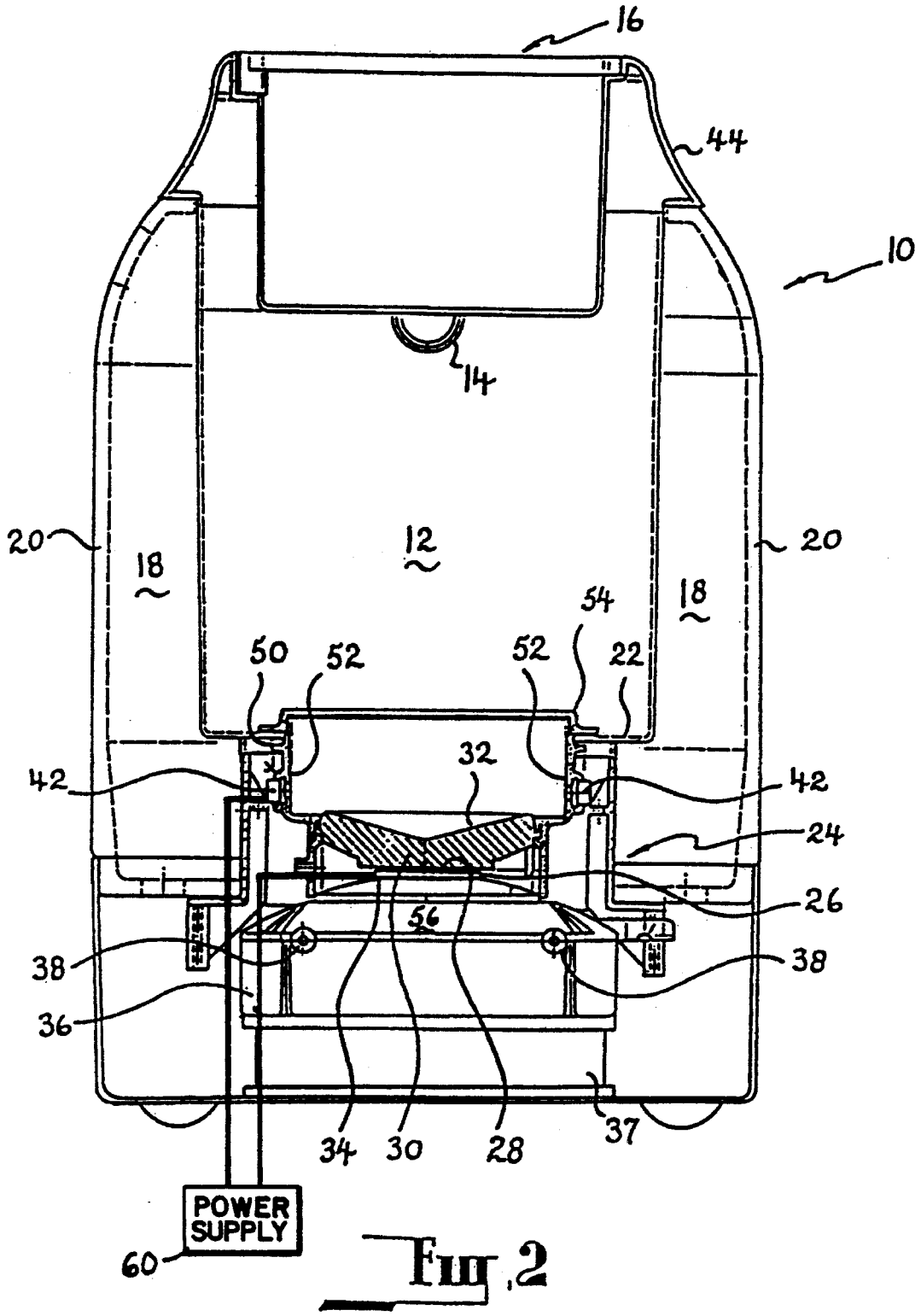
FIG. 2 is a cross sectional view of a preferred embodiment of the water cooler of FIG. 1.

Illustrated in FIG. 2 is a water cooler 10 having a cooling chamber 12, a dispensing outlet 14 and a water bottle receiving neck 16. The cooling chamber 12 is substantially surrounded by insulating material 18 and is within an outer shell 20 that may be constructed of any preferred material, such as a ceramic material.

Located in the bottom wall 22 of the cooling chamber 12 is the ice producing means generally indicated by the numeral 24. The ice producing means 24 comprises a thermoelectric module 26 having a cold-side interface 28 which abuts a cold side heat sink 30 which in turn has a cooling surface 32 in the form of a stainless steel face. The thermoelectric module 26 also has a hot-side interface 34 which abuts and is connected to a hot side sink 36.

The ice producing means is virtually provided as a single unit in the form of a cooling module 50 that includes housings 52 for the sensing means 42 and may be moulded with the cold-side heat sink 30 in place. The cooling module 50 may then be located within an appropriately sized opening in the bottom wall 22 of the cooling chamber 12 and secured thereto by an annular lock nut 54 threadably received at the top end of the module 50.

The cooling module 50 may then be secured and sealed against the upper domed portion 56 of the hot-side heat sink 36, with the thermoelectric module 26 located in abutment therebetween.

The hot-side sink 36 functions to remove heat from the thermoelectric module 26 and is in the form of an aluminium construction having fins arranged perpendicularly to a flat base, thus being capable of radiating heat carried by the fins away from the thermoelectric module. A fan 37 or the like is preferably arranged to pass air across the surfaces of the fins of the heat sink. It will also be understood that the hot-side sink 36 may be made of materials other than aluminium, such as copper and the like.

The cooling surface 32 has smoothly tapered surfaces so that the ice block which is generated thereon during operation of the water cooler will easily release therefrom when the power supply to the thermoelectric module is switched off. Furthermore, the cooling surface 32 is concave, preferably in the general form of an inverted cone as illustrated.

The power supply unit of the invention is shown functionally as block 60 in FIG. 2 of the drawing, but may be any suitable power supply which is able to be located adjacent the ice generating apparatus 24 such as at bolting points 38. Of course, the power supply unit is connected to the sensing means 42 which is in the form of a photo-optic sensing device which comprises a source of an infra red beam and a receiver of that infra red beam such as a photo transistor. By drawing a line directly between the two parts of the sensing means 42 it can be seen that an ice block will be allowed to generate on the cooling surface 32 to a predetermined thickness.

When in operation, the thermoelectric module 26 absorbs heat from its cold-side interface 28 via the cold-side sink 30. Thus, heat from the cooling surface 32 is also absorbed, creating a colder temperature in the cooling surface than in the surrounding water. Thus, ice begins to generate on the cooling surface 32.

Once the ice reaches a thickness where the infra red beam of the sensing means 42 is broken, the sensor will switch off the power supply. On switching off the power supply, the heat generated within the heat sink 36 transfers through the thermoelectric module 26 to the cold-side heat sink 30 and subsequently to the cooling surface 32. A thin layer of ice immediately adjacent to the cooling surface 32 begins to defrost until the ice block located on the cooling surface 32 is able to break away therefrom. This ice block will then float upwards towards the surface of the water in the cooling chamber 12. Once this ice block has moved away from the sensing means 42, the power supply will be turned back on by the sensor switch and the thermoelectric module will again begin operating to cool the cooling surface 32 and thus create another block of ice. This procedure continues with a series of ice blocks being created and released into the body of the cooling chamber until the cooling chamber is full of ice blocks and thus those ice blocks remain breaking the infra red beam. Until some of those ice blocks melt to allow the ice blocks at the bottom to move upwardly and out of the infra red beam, the power supply will not be switched on and the thermoelectric module will not reactivate to create more ice. However, once the infra red beam is again clear, further ice will be created.

The water cooler illustrated also includes a water baffle cap 44. The water baffle cap 44 sits within the upper end of the cooling chamber 12 and serves both to define the water bottle receiving neck 16 and to separate the freshly supplied water of the water bottle from the iced water within the cooling chamber. Furthermore, the water baffle cap 44 also includes a split outlet which provides a water mixing capability for mixing the cooled water of the cooling chamber 12 with the ambient water provided by the water bottle through neck 16. The provision of the water mixing capability is preferred in order that the cooled water provided for drinking from the dispensing outlet 14 is not unacceptably cold. Thus, water is drawn from immediately above the water baffle cap 44 to be mixed with the cooled water from cooling chamber 12 upon operation of the dispensing outlet. It will be appreciated that other features for providing water mixing capability devices or ice dispersing devices may be utilised with the water cooler of the present invention if necessary. It will also be appreciated that a water cooler may be provided having any required external configuration or any required configuration for joining or sealing with a water bottle of any type.

It will further be appreciated that the water cooler of the present invention may be readily adapted to be used with a continuous water supply system such as a mains water supply system. While some adaptation will be necessary, that adaptation would nonetheless still utilise the inventive concepts of the present invention.

Thus, the present invention provides a water cooler which may be provided in an extremely compact form. Indeed, the only part of the cooling apparatus that requires any appreciable amount of space is in fact the heat sink on the hot side interface of the thermoelectric module. However, the heat sink required for this purpose is relatively small compared to those required for normal refrigeration facilities on traditional water coolers. Furthermore, the water cooler of the present invention requires far less energy to operate and is able to provide colder water more consistently over a longer period of time. There are no moving parts, apart from the fan, in the cooling apparatus of the water cooler of this invention, and accordingly the risk of failure or break down of the water cooler of this invention is far less than traditional water coolers. Furthermore, the water cooler of the invention does not use any chlorofluorocarbon (CFC) gases which may deplete the ozone layer, unlike conventional water coolers.

Those skilled in the art will appreciate that there may be many variations and modifications of the configurations described herein which are within the scope of the present invention. In particular, it will be appreciated that the concept of the invention may be extended for use in non-drinking water cooling situations, such as in situations where ice production by the above described method and apparatus would be advantageous, whether or not cooling of a liquid is the end objective. Nonetheless, the major advantage of the present invention lies in its use as a water cooler as described.

We claim:

1. A water cooler which produces ice and then uses the energy stored in the ice to cool drinking water, the water cooler having a supply of drinking water in fluid communication with a cooling chamber, there being an ice producing means located at least partially within the cooling chamber, the ice producing means including a thermoelectric module having a cold-side interface and a hot-side interface, the cold-side interface being in communication with water in the cooling chamber and the hot-side interface being located externally of the cooling chamber and being connected to a hot-side heat sink for the dissipation of heat generated thereby, the water cooler also including a power supply connected to the thermoelectric module, and a sensing means, wherein as heat is absorbed from the water by the cold-side interface, local freezing of the water immediately about the cold-side interface occurs and ice is produced thereon, the sensing means being capable of determining when ice of a predetermined dimension has been formed on the cold-side interface and controlling the power supply to interrupt cooling of the cold-side interface until the ice releases from the cold-side interface and is clear of the sensing means.

2. A water cooler according to claim 1 wherein the sensing means is in the form of a photo-optic sensing device capable of generating a beam of light and receiving that beam by a sensor.

3. A water cooler according to claim 2 wherein the beam passes over the cold-side interface such that the ice produced thereon will break the beam and the power supply to the module will switch off allowing the heat of the hot-side interface to transfer to the cold-side interface causing a thin layer of ice to melt releasing the ice into a cooling chamber, the beam then being restored, switching the power to the module back on and allowing the production of more ice.

4. A water cooler according to claim 1 including a water baffle cap which is provided to separate an inverted water bottle from the cooling chamber, and which serves to prevent the ice generated from flowing into the bottle and to prevent the water in the bottle from becoming too cold.

5. A water cooler according to claim 1 wherein the cold-side interface is indirectly in communication with the water, there being a cooling surface and a cold-side heat sink located intermediate the cold-side interface and the water.

6. A water cooler according to claim 5 wherein the cold-side heat sink is an aluminium block, the surface of which is the cooling surface, and having a stainless steel face.

7. A water cooler according to claim 5 wherein the cold-side heat sink is configured to be generally concave.

8. A water cooler according to claim 1 wherein the cooling chamber is an insulated chamber and the water cooler is located substantially within a ceramic outer shell.

9. A water cooler according to claim 1 wherein the ice producing means is provided as a single unit, comprising a cooling module having housings for the sensing means and being moulded with the cold-side heat sink in place.

10. A cooling system which produces ice and then uses the energy stored in the ice to cool a liquid, the cooling system having a supply of liquid in fluid communication with a cooling chamber, there being an ice producing means located at least partially within the cooling chamber, the ice producing means including a thermoelectric module having a cold-side interface and a hot-side interface, the cold-side interface being in communication with liquid in the cooling chamber and the hot-side interface being located externally of the cooling chamber and being connected to a hot-side heat sink for the dissipation of heat generated thereby, the cooling system also including a power supply connected to the thermoelectric module, and a sensing means, wherein as heat is absorbed from the liquid by the cold-side interface, local freezing of the liquid immediately about the cold-side interface occurs and ice is produced thereon, the sensing means being capable of determining when ice of a predetermined dimension has been formed on the cold-side interface and controlling the power supply to interrupt cooling of the cold-side interface until the ice releases from the cold-side interface and is clear of the sensing means.

11. A cooling system according to claim 10 wherein the sensing means is in the form of a photo-optic sensing device capable of generating a beam of light and receiving that beam by a sensor.

12. A cooling system according to claim 11 wherein the beam passes over the cold-side interface such that the ice produced thereon will break the beam and the power supply to the module will switch off allowing the heat of the hot-side interface to transfer to the cold-side interface causing a thin layer of ice to melt releasing the ice into a cooling chamber, the beam then being restored, switching the power to the module back on and allowing the production of more ice.

13. A cooling system according to claim 10 including a water baffle cap which is provided to separate an inverted water bottle from the cooling chamber, and which serves to prevent the ice generated from flowing into the bottle and to prevent the water in the bottle from becoming too cold.

14. A cooling system according to claim 10 wherein the cold-side interface is indirectly in communication with the water, there being a cooling surface and a cold-side heat sink located intermediate the cold-side interface and the water.

15. A cooling system according to claim 14 wherein the cold-side heat sink is an aluminium block, the surface of which is the cooling surface, and having a stainless steel face.

16. A cooling system according to claim 14 wherein the cold-side heat sink is configured to be generally concave.

17. A cooling system according to claim 10 wherein the cooling chamber is an insulated chamber and the water cooler is located substantially within a ceramic outer shell.

18. A cooling system according to claim 10 wherein the ice producing means is provided as a single unit, comprising a cooling module having housings for the sensing means and being moulded with the cold-side heat sink in place.

19. A method for cooling liquid, said method comprising producing ice on or in relation to the cold-side interface of a thermoelectric module, switching the power to the thermoelectric module off when the ice reaches a predetermined size thus allowing heat from the hot-side interface to transfer to the cold-side interface to melt a thin layer of ice adjacent thereto, allowing the ice to release from the cold-side interface and transfer into a cooling chamber filled with liquid to cool that liquid, the power to the thermoelectric module being switched on when the ice releases from the cold-side interface to produce more ice thereon, wherein a sensing means is provided to detect when the ice has reached the predetermined size and to switch the power to the module on and off.

20. A method according to claim 19 wherein the liquid is drinking water.

21. A method according to claim 19 including mixing the cooled liquid with incoming ambient liquid and having a liquid dispensing means in communication with the mixed liquid for dispensing as necessary.

* * * * *